United States Patent [19]

Feldmann et al.

[11] Patent Number: 4,936,047

[45] Date of Patent: Jun. 26, 1990

[54] METHOD OF CAPTURING SULFUR IN COAL DURING COMBUSTION AND GASIFICATION

[75] Inventors: Herman F. Feldmann, Worthington; Byung C. Kim, Columbus, both of Ohio

[73] Assignee: Battelle Development Corporation, Columbus, Ohio

[21] Appl. No.: 186,659

[22] Filed: Apr. 20, 1988

Related U.S. Application Data

[63] Continuation of Ser. No. 52,117, Apr. 24, 1987, abandoned, which is a continuation of Ser. No. 859,422, May 15, 1986, abandoned, which is a continuation of Ser. No. 414,834, Sep. 3, 1982, abandoned, which is a continuation-in-part of Ser. No. 206,188, Nov. 12, 1980, abandoned.

[51] Int. Cl.[5] ..... C10J 3/00; C10J 3/54

[52] U.S. Cl. ..... 48/197 R; 48/203; 48/210; 110/342; 110/345; 110/347; 122/4 D

[58] Field of Search ..... 48/197 R, 203, 206, 48/210; 44/15 R; 24/77; 110/342, 345, 347; 122/4 D

[56] References Cited

U.S. PATENT DOCUMENTS

| | | | |
|---|---|---|---|
| 3,717,700 | 2/1973 | Robison et al. | 110/345 |
| 3,847,563 | 11/1974 | Ardly et al. | 48/206 |
| 4,111,755 | 9/1978 | Ban et al. | 110/342 |
| 4,232,615 | 11/1980 | Brown | 110/342 |
| 4,262,610 | 4/1981 | Heis et al. | 110/342 |
| 4,285,283 | 8/1981 | Lyon et al. | 48/210 |
| 4,440,546 | 4/1984 | Lancet et al. | 48/202 |

FOREIGN PATENT DOCUMENTS

| | | | |
|---|---|---|---|
| 2897416 | 5/1980 | Fed. Rep. of Germany | 48/206 |
| 1439317 | 6/1976 | United Kingdom | 48/206 |

*Primary Examiner*—Peter Kratz

*Attorney, Agent, or Firm*—Finnegan, Henderson, Farabow, Garrett & Dunner

[57] ABSTRACT

A method of reducing the amount of gaseous sulfur compounds released during combustion of sulfur-containing fuel, comprising the steps of: (a) preparing a mixture of sulfur containing particulate fuel and a sulfur absorbent, such as calcium oxide, calcium hydroxide, calcium carbonate, lime, limestone, dolomite, or mixtures thereof; (b) exposing the mixture to a reducing atmosphere at a temperature of at least about 1500° F., so as to convert at least a portion of the particulate fuel into a gaseous portion and a solid, char portion; and (c) combusting the char portion, thereby forming an ash containing sulfur fixed therein.

10 Claims, 5 Drawing Sheets

METHOD OF CAPTURING SULFUR IN COAL DURING COMBUSTION AND GASIFICATION

This is a continuation of application Ser. No. 052,117, filed Apr. 24, 1987, which was a continuation of application Ser. No. 859,422 filed May 15, 1986, which was a continuation of application Ser. No. 414,834 filed Sept. 3, 1982, which was a continuation-in-part of Ser. No. 206,188, filed Nov. 12, 1980, all abandoned.

BACKGROUND OF THE INVENTION

The present invention relates to the enhancement of sulfur capture during combustion or gasification of solid, sulfur-containing carbonaceous fuel, and more particularly to a method of processing a mixture of particulate coal and a sulfur absorbent in order to enhance the ability of the sulfur absorbent to capture sulfur during combustion or gasification.

Although coal is a major source of energy in the United States, it is well known that combustion of coal having a high sulfur content can produce considerable air pollution, as well as an ash containing leachable forms of sulfur constituting a health hazard. One technique for suppressing pollutants such as sulfur dioxide and leachable sulfur in the ash, resulting from combustion or gasification of high-sulfur coal, is to physically mix the coal with a sulfur absorbent, e.g., calcium oxide (CaO), calcium hydroxide ($Ca(OH)_2$) or calcium carbonate ($CaCO_3$) prior to combustion or gasification. This technique has been used extensively in connection with fluidized bed combustion and gasification processes. Prior art workers have found, however, that satisfactory sulfur capture during fluidized bed combustion of coal-sulfur absorbent mixtures occurs only if the temperature in the fluidized bed combustor does not exceed 1650° F. Thus, presentday fluidized bed combustion systems burning coal-sulfur absorbent mixtures are designed accordingly, despite the distinct advantages that could be achieved at high combustion temperatures, e.g., higher heat transfer rates and steam temperatures.

It is recognized that industry acceptance of fixed-bed type gasifiers has been barred, at least in part, because of the fact that the raw products from such gasifiers contain a liquid hydrocarbon phase, e.g., tars. Tar formation reduces carbon conversion to product gas and creates additional handling and disposal problems, thus complicating plant design and operations, and creating potential health and environmental concerns. Moreover, fixed-bed gasifiers typically include a combustion zone or zones operating at temperatures previously considered to be in excess of those required for effective sulfur capture.

U.S. Pat. No. 4,111,755 discloses a method of producing a pelletized fixed-sulfur coal or coke. A mixture of coal and a sulfur absorbent (limestone) is ground and blended and then balled or compacted to form pellets, and these pellets are then subjected to either a pyrolyzing or carbonizing technique at high temperatures within a reducing or slightly oxidizing environment to cause simultaneous high-temperature decomposition of the hydrocarbonaceous matter of the coal, i.e. removal of the volatiles, and calcination, with sulfur fixation of the basic constituents. The overall intent of the pelletizing operation is to co-react limestone particles with coal particles during pyrolysis or carbonizing so as to cause sulfur to react and fix with the lime while the coal is undergoing pyrolytic decomposition. The final result is a pellet which, because of its size and lack of volatile matter, cannot be burned in a pulverized coal furnace.

It is an object of the present invention to provide a method of enhancing sulfur capture by sulfur absorbents during combustion or gasification of particulate fuel, and to substantially reduce the caking tendencies of most coals during gasification.

A further object of the invention is to permit satisfactory sulfur capture to occur in fluidized bed combustion systems operating at temperatures in excess of 1650° F.

It is a further object of the present invention to provide satisfactory sulfur capture without the need for pelletization of the coal, and without requiring pyrolysis or carbonization of the coal to remove the volatile matter and fix the sulfur.

Still another object of the present invention is to enhance the performance of fixed-bed gasification systems, and in particular, to substantially reduce or eliminate the liquid hydrocarbon phase (tars) normally included in the raw products from such fixed-bed gasifiers, and to permit sulfur capture in the combustion zone or zones of such gasifiers at temperatures considerably higher than previously thought possible.

We have also found that the process of the present invention yields a significant increase in the volatile matter present in the treated coal.

SUMMARY OF THE INVENTION

The present invention overcomes the problems and disadvantages of the prior art by providing a method of enhancing sulfur capture during combustion or gasification of a particulate fuel by exposure of a coal-sulfur absorbent mixture to reducing conditions prior to combustion. In a preferred embodiment of the invention, the coal-sulfur absorbent mixture is prepared by a hydrothermal process.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and, in accordance with the purpose of the invention, as embodied and broadly described herein, the method of this invention comprises a method of reducing the amount of gaseous sulfur compounds released during combustion of sulfur-containing fuel, comprising the steps of: (a) preparing a mixture of sulfur-containing particulate fuel and a sulfur absorbent; and (b) exposing said mixture to a reducing atmosphere at a temperature of at least about 1500° F., so as to convert at least a portion of the particulate fuel into a gaseous portion, and a solid, char portion; and (c) combusting said char portion, thereby forming an ash containing sulfur fixed therein.

Typically, the sulfur absorbent comprises calcium oxide, calcium hydroxide, calcium carbonate, lime, limestone, dolomite, or mixtures thereof, and sufficient sulfur absorbent is utilized to provide a ratio of moles of absorbent to moles of sulfur in the particulate fuel of about three.

The accompanying drawings, which are incorporated in and constitute a part of this specification, illustrate various embodiments of the invention and, together with the description, serve to explain the principles of the invention.

DESCRIPTION OF THE PREFERRED EMBODIMENT

Reference will now be made in detail to the presently preferred embodiments of the invention.

We have found that sulfur capture by conventional sulfur absorbents, e.g., lime, during combustion or gasification of particulate fuels can be greatly enhanced by exposure of a mixture of coal particles and absorbent to reducing conditions immediately prior to combustion or gasification of the mixture. The coal-absorbent mixture may be subjected to reducing conditions by applying a reducing atmosphere in any conveniently constructed, enclosed reactor. For example, conventional gasification reactors are suitable for use in the present invention. Such a chamber or reactor may be integrated intO a coal feeding system designed to supply coal to a combustor or a gasifier, or may be constructed as auxiliary equipment to such combustors or gasifiers. In practicing the invention, it is important to keep the following factors in mind: (1) the ratio of sulfur absorbent to sulfur contained in the coal; (2) residence time in the reducing atmosphere; (3) temperature of the reducing atmosphere; (4) method of combining coal with sulfur absorbent; (5) type of sulfur absorbent used; (6) carbon conversion in the reducing atmosphere; (7) combustion temperature; (8) excess air level during combustion; and (9) steam injection. A factor of lesser importance is the composition of the reducing atmosphere.

It is preferable to use a compound of calcium as the sulfur absorbent. Calcium oxide, calcium hydroxide, calcium carbonate, and mixtures thereof, such a limestone, lime, or dolomite, are particularly preferred. We have found that in order to achieve 80 to 85 percent sulfur removal, a sufficient amount of calcium compound should be used to provide a mole ratio of calcium compound to sulfur in the coal of about 3 or greater.

In order to permit satisfactory sulfur capture, at least some carbon conversion, i.e., conversion from a solid to the gaseous or liquid state, must be achieved in the reducing reactor. We have found, that for carbon conversion ranging from about 50 to 90 percent, satisfactory sulfur capture has resulted. However, satisfactory results should be achievable at carbon conversion levels on the order of about 20 percent. The temperature within the reducing reactor, and the residence time of the coal-absorbent mixture in the reducing reactor should, therefore, be adjusted using conventionally known techniques, in order to achieve sufficient carbon conversion. At temperatures of about 1500° F. to 1800° F., and residence times ranging from about 25 to 60 minutes in the reducing reactor, carbon conversions ranging from about 5 to 60 percent at the shorter residence times to about 90 percent at the longer residence times, have been achieved with acceptable sulfur capture.

Figure 1:
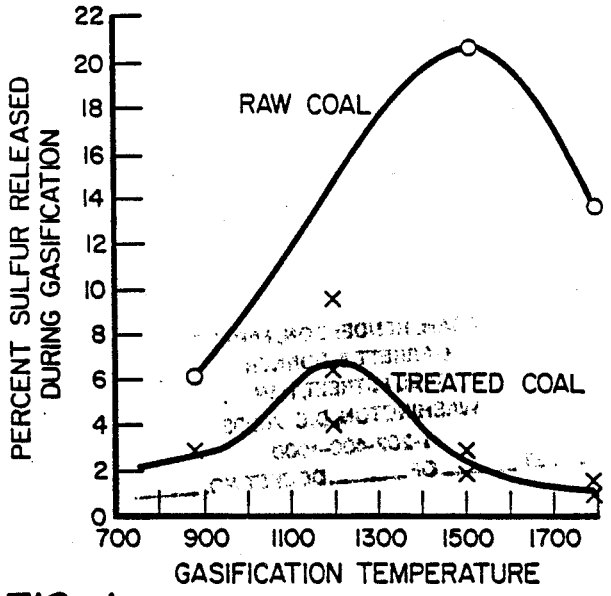
FIGS. 1, 3, 6, and 7 are graphs showing some significant and unexpected advantages of the invention.

Care must be taken to maintain the temperature in the reducing reactor at a level which will not promote sulfur release, since any sulfur released in the reducing reactor will not be captured by the sulfur absorbent. FIG. 1 shows the effect of reducing-reactor temperature on sulfur release for both raw coal and coal treated with calcium oxide. Since sulfur released is maximized for the calcium oxide treated coal between about 1000° F. and 1500° F., reducing reactor temperatures should be maintained at least about 1500° F., and preferably about 1800° F.

Reducing conditions may be maintained in the reducing reactor by maintaining the temperature in the reactor sufficiently high to produce carbon conversion, and by maintaining the air to coal ratio in the reactor at a value low enough to have excess carbon, in the form of char, in the reactor, and therefore no free oxygen in the reactor, or by recycle of a portion of the product gas from the reactor. Two specific gas compositions which we have found suitable for establishing reducing conditions are as follows: (1) 13% $H_2$, 25% CO, 3% $CO_2$, 47% $N_2$ and 12% $H_2O$; and (2) 14% $H_2$, 22% CO, 7% $CO_2$, 57% $N_2$ (dry basis), and 15%-25% $H_2O$ (wet basis). The fact that these two compositions, which are typical of two different types of conventional gasifiers are suitable, indicates a relatively high degree of freedom in selecting the gas composition in the reducing reactor.

If the coal is to be used in a reducing reactor comprising, for example, a conventional gasification reactor, agglomeration of the coal in the reactor may present a significant problem. This will be particularly so with respect to coal from deposits in the eastern United States. In order to overcome this problem, it will be necessary to either utilize a special type of reducing reactor (gasifier) which will allow the handling of agglomerating coals, such as an entrained gasifier, a draft-tube (e.g. Westinghouse) type gasifier, or a multisolid fluidized bed gasifier (see, e.g., U.S. Pat. No. 4,084,545 assigned to a common assignee), or the coal may be subjected to a suitable pretreatment process designed to render the coal non-agglomerating under reducing-conditions.

One such process which we have found to be effective is the mixing of the coal with an aqueous alkaline solution containing the sulfur absorbent in a slurry treatment process at ambient conditions; that is, in the absence of any external heat addition. Such ambient conditions will include, for example, the heat naturally generated as a result of the lime slaking reaction taking place due to the combination of CaO and $H_2O$. Conditions of elevated temperature and elevated pressure may, however, be used where necessary to render the coal non-agglomerating. We have found that the use of sufficient calcium oxide to provide a ratio of calcium oxide to sulfur contained in the coal of approximately three moles to one mole may be used in a particularly cost-effective manner to render coal sufficiently non-agglomerating for use in conventional gasifiers (reducing reactors).

The use of a sulfur absorbent in the above-described pretreatment process will obviously serve two purposes in the present invention. In addition to rendering the coal non-agglomerating, such a pretreatment process provides a convenient means for mixing the sulfur absorbent with the coal prior to entering the reducing reactor.

Figure 2:
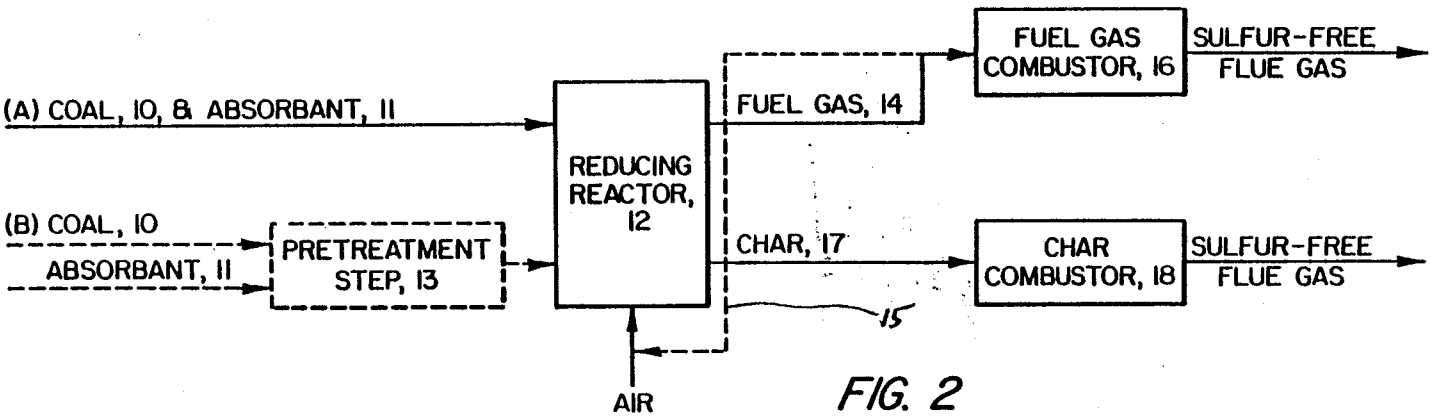
FIGS. 2, 4, and 5 are flow diagrams illustrating typical steps in practicing the present invention.

FIG. 2 is a flow diagram illustrating typical steps in practicing the present invention for providing enhanced sulfur capture during combustion. As discussed above, and as shown in the flow line labeled (A), the coal 10 may be merely physically mixed with a suitable sulfur absorbent 11 and fed directly to the reducing reactor 12, provided the reactor is constructed so as to permit the handling of agglomerating coals without pretreatment. Alternately, as shown in the flow line labeled (B), if it is desired to use a conventional (non-specialized) gasifier as the reducing reactor 12, the coal 10 and absorbent 11 may be subjected to a pretreatment step 13, as described above, prior to entering the reducing reactor 12. A reducing atmosphere is maintained in the reducing reactor by maintaining the air to coal ratio at a value low enough to result in excess carbon, in the form of char, in the reactor, and therefore no free oxygen, or by recycle of a portion of the fuel gas 14 leaving the reactor, as shown by flow line 15. The remaining portion of the fuel gas 14 is fed to a fuel gas combustor 16 to produce useful heat and a sulfur-free flue gas. The char 17 from the reducing reactor is fed to a char combustor 18, or oxidizing zone, where combustion of the carbon is completed, producing useful heat and sulfur-free flue gas.

Exposure of the coal and sulfur absorbent to reducing conditions in the reducing reactor 12 allows subsequent capture of the sulfur by the absorbent in the char combustor 18 at much higher temperatures than if the mixture were unexposed and simply burned at the same overall air to coal ratio. Temperatures in the char combustor 18 may be maintained on the order of 2100° F., which, as noted above, will produce significantly higher heat transfer rates and steam temperatures than could be achieved at lower combustion temperatures, while still maintaining satisfactory sulfur capture by the sulfur absorbent. As stated earlier, one of the primary objectives of fluidized bed combustion technology, where no prior reducing conditions are employed, is to limit the combustion temperature to 1650° F. in order to achieve satisfactory sulfur capture.

Figure 3:
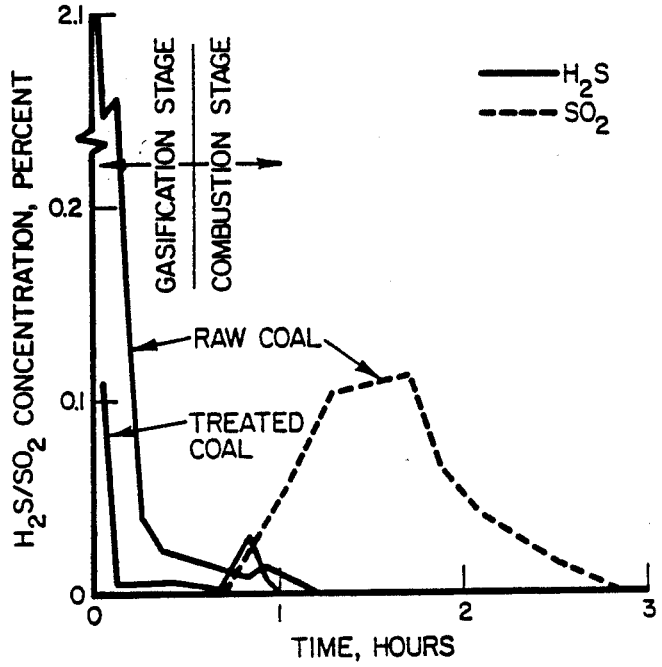

The ability of prior exposure of the coal-sulfur absorbent mixture to reducing conditions to allow sulfur capture to occur at much higher combustion temperatures than the prior art recognizes is illustrated by the results shown in the graph depicted in FIG. 3. This graph shows the level of $H_2S$ and $SO_2$ concentration in percent, in product gases from a coal-sulfur absorbent mixture subjected to reducing (gasification) conditions immediately prior to combustion. The raw coal was pretreated with an aqueous solution containing calcium oxide (mole ratio of calcium to sulfur in the coal of 3) and a small amount of sodium hydroxide (0.003 lb. per lb of moisture-free coal) at ambient temperature and a pressure of 1000 PSIG for 10 minutes.

The results shown demonstrate that virtually no sulfur ($SO_2$) release occurs from a coal which was subjected to pretreatment with calcium oxide in the manner described above and subjected to exposure to reducing conditions, in the form of a gasifying environment, immediately prior to combustion, despite the fact that the combustion temperature was approximately 2100° F. In this example, approximately 85 percent of the sulfur was retained in the coal ash. For comparison, a sample of raw coal, without any sulfur absorbent, was subjected to the identical reducing atmosphere and combustion conditions. As can be seen in FIG. 3, the raw coal produced significant levels of $SO_2$.

Although a precise explanation of the unexpected results of the present invention is not possible at the present time, one possible explanation is that oxidizing conditions poison the sulfur absorbent by poisoning its reactivity with respect to sulfur capture.

Figure 4:
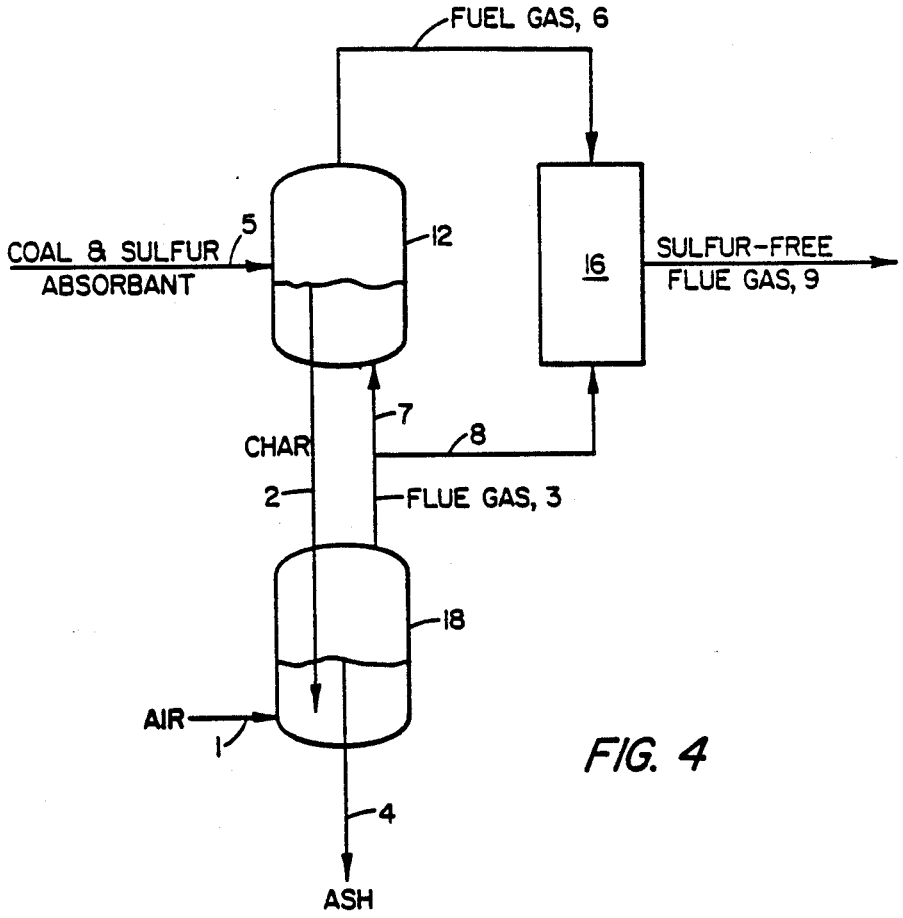

FIG. 4 shows another flow diagram illustrating a further embodiment of the invention. In this embodiment, the reducing conditions are established within the gasification zone (reducing reactor) of an integrated system having a gasification zone 12 and a combustion zone 18. The coal-sulfur absorbent mixture 5 is fed into the gasification zone 12. The mixture may be pretreated to render the coal non-agglomerating, as described above, depending on the construction of the reactor 12. Conditions are maintained reducing in the gasification zone 12 by maintaining the air to coal ratio at a value low enough to have excess carbon in the form of char in the zone and therefore no free oxygen, or by recycle of a portion (not shown) of the gas from the reducing-/gasification zone 12. The temperature in the gasification zone 12 should be maintained sufficiently high to achieve carbon conversion on the order of at least 50 percent. Temperatures on the order of 1500° F. should prove sufficient. The char 2 produced in the reducing-/gasification zone is then fed into a combustion (oxidizing) zone 18 where combustion of the carbon is completed. Temperatures in the combustion zone 18 are controlled at the desired temperature, on the order of 2100° F., by having the oxidizing zone 18 operate at a high excess air level. The high level of oxygen in the combustion zone 18 will promote the oxidation of calcium sulfide to calcium sulfate, and tend to minimize the decomposition of calcium sulfate to calcium oxide and sulfur dioxide. Since the adiabatic combustion temperature will, in general, be much higher than that at which calcium sulfate is stable, means to reduce the combustion temperature should be employed. One means of temperature control is by the utilization of excess combustion air. Part of the flue gas from the combustion/oxidizing zone, which contains excess oxygen, bypasses the reducing zone 12 and is blended with the non-oxygen containing fuel gas 6 from the reducing zone in a separate combustor 16, which may, for example, comprise a conventional boiler, to produce sulfur free flue gas.

The remaining portion 7 of the flue gas 3 from the combustion/oxidizing zone 18 is fed to the reducing zone 12.

As further illustrated in FIG. 4, air is supplied to the combustion zone 18, while calcium sulfate-containing ash is removed from the combustion zone 18. Temperatures in the combustion zone 18 are preferably maintained over 2000° F., and temperatures as high as 2400° F. may be possible.

Heat and material balances illustrating the feasibility of the present invention are summarized in Table 1, presented below. The stream numbers 1–9 shown on Table 1 refer to the process streams identified in FIG. 4. The assumptions used in connection with the generation of Table 1 are as follows: (1) coal-sulfur absorbent mixture pretreated with 0.5 moles calcium carbonate per mole of sulfur in the coal using an aqueous slurry treatment at ambient temperature and pressure, and dried to 5% moisture level; (2) Illinois No. 6 coal containing 4.7% sulfur on a dry basis; (3) reducing/gasification zone temperature at 1800° F. and combustion zone temperature at 2100° F.; (4) 75% steam decomposition in the gasification zone; (5) 5% excess air based on overall combustion of the coal fed to the process; and (6) no heat losses. Table 1 is based on our experimental finding that it is possible to retain sulfur in the ash at temperatures at least as high as 2100° F. if the coal-sulfur absorbent mixture is first exposed to reducing conditions. In this application of the invention, the theoretical final combustion temperature achieved is 3740° F., which is achieved by burning the hot fuel gas from the reducing zone with the oxygen-rich flue gas from the combustion zone, as shown in FIG. 4. Because this application of the invention

TABLE 1

PROCESS STREAM SUMMARY
Basis: 100 lb Treated Coal (Stream 5)

| Stream No. | 1 | 2 | 3 | 4 | 5 | 6 | 7 | 8 | 9 |
|---|---|---|---|---|---|---|---|---|---|
| Temp, F. | 60 | 1800 | 2100 | 2100 | 60 | 1800 | 2100 | 2100 | 3750 |
| Moles | | | | | | | | | |
| C | — | 1.99 | — | — | 3.75 | — | — | — | — |
| H | — | — | — | — | 3.77 | — | — | — | — |
| N | — | — | — | — | 0.06 | — | — | — | — |
| S | — | — | — | — | 0.10 | — | — | — | — |
| O | — | — | — | — | 0.31 | — | — | — | — |
| $H_2O$ | 0.21 | — | 0.21 | — | 0.43 | 0.14 | 0.05 | 0.15 | 2.58 |
| Ash (lb) | — | 7.41 | — | 7.41 | 7.41 | — | — | — | — |
| $CaCO_3$ | — | — | — | — | 0.24 | — | — | — | — |
| $Ca(OH)_2$ | — | — | — | — | 0.05 | — | — | — | — |
| CaO | — | 0.19 | — | 0.19 | — | — | — | — | — |
| CaS | — | 0.10 | — | — | — | — | — | — | — |
| $CaSO_4$ | — | — | — | 0.10 | — | — | — | — | — |
| $O_2$ | 4.87 | — | 2.68 | — | — | — | 0.75 | 1.94 | 0.20 |
| $N_2$ | 18.32 | — | 18.32 | — | — | 5.15 | 5.11 | 13.21 | 18.36 |
| CO | — | — | — | — | — | 1.20 | — | — | — |
| $CO_2$ | — | — | 1.99 | — | — | 1.35 | 0.55 | 1.44 | 3.99 |
| $H_2$ | — | — | — | — | — | 2.29 | — | — | — |
| HHV,[a] $10^6$ Btu | 0 | 0.378 | 0 | 0 | 0.859 | 0.428 | 0 | 0 | 0 |
| $\Delta H$,[b] $10^6$ Btu | 0 | 0.017 | 0.386 | 0.013 | 0 | 0.144 | 0.108 | 0.278 | 0.850 |

[a]Higher heating value; reference temperature at 60 F.

allows the separation of most of the solid particulates from the combustion products, and allows the attainment of a combustion temperature approximately equal to that of petroleum or natural gas, it has the potential of providing a relatively simple and economic means of substituting coal for petroleum-based fuels in utilities and other applications. Other key advantages are that it does not require any major change in boilers currently using petroleum-based fuels, and the system could be completely erected before switching fuels, thereby eliminating the need to curtail users of power or steam during retrofitting.

Figure 5:
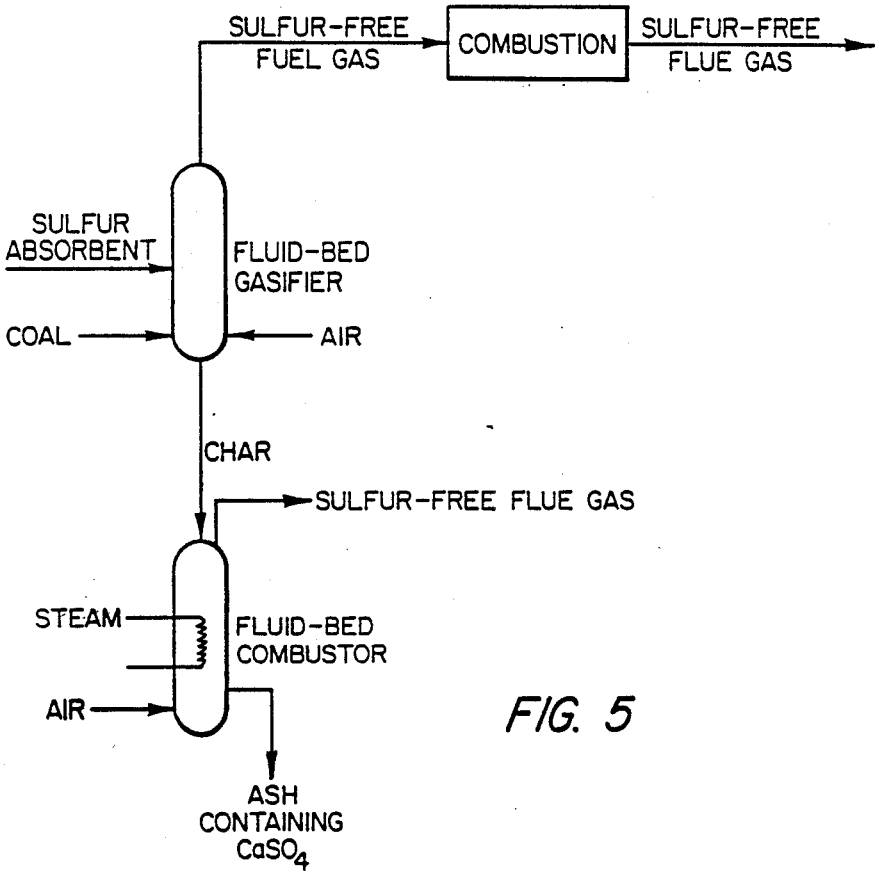

FIG. 5 is a flow diagram illustrating typical steps in practicing a further embodiment of the present invention. In this embodiment, a fluidized bed gasifier/reducing reactor is used, and the sulfur-containing char is used as fuel for a fluidized bed combustor. The advantages of this type of system are as follows: (1) a clean fuel gas is produced, which could be used where a gaseous fuel is desirable or necessary; (2) the fluidized bed combustor can operate at temperatures much higher (at least 2100° F.) than conventional fluidized combustors (1650° F.), because of the pre-exposure of the coal-sulfur absorbent mixture to reducing conditions; (3) at higher operating temperatures of the fluidized bed, a less leachable ash will be produced.

As noted earlier, the adiabatic combustion temperature in the fluidized bed combustor will, in general, be much higher than that at which the calcium sulfate formed in the ash remains stable. Therefore, means to reduce the combustion temperature should be employed. One means of temperature control is by external heat removal in the form of steam generation, as illustrated in FIG. 5.

Figure 6:
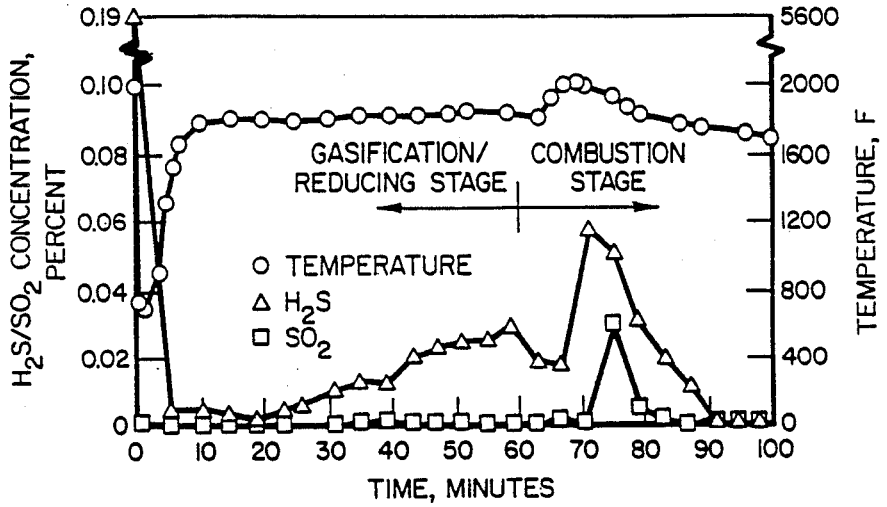
Figure 7:
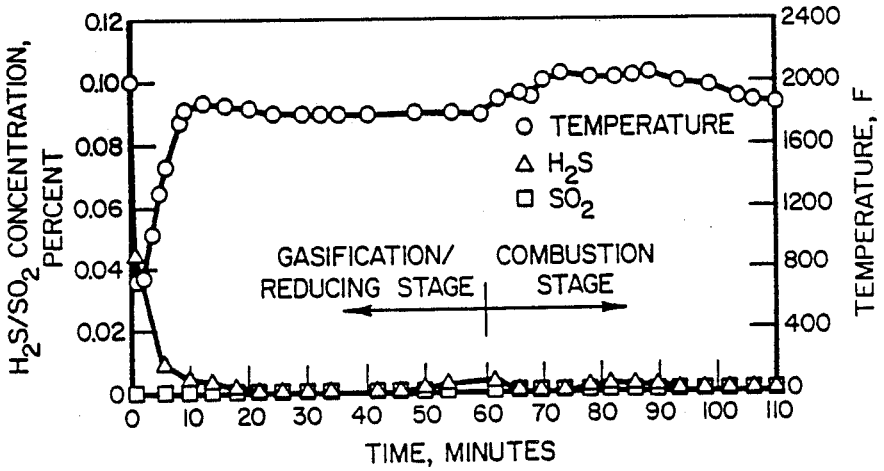

We have found that the presence of steam in the combustion stage is quite deleterious to sulfur capture. The effect of steam injection into the combustion stage is illustrated by the data plotted on the graph depicted in FIG. 6. This data shows the sulfur release when steam is injected during the combustion stage, and is to be compared with the results depicted in FIG. 7, which shows virtually no sulfur release during combustion in the absence of added steam. Therefore, it is important to reduce steam concentrations as much as possible. Although one important reason for steam addition during gasification is to reduce temperatures to prevent ash fusion, with the added sulfur absorbent, e.g., calcium oxide or limestone, the ash fusion temperature will be increased, thus allowing a reduction in steam requirements.

The above-noted discovery is of particular importance in applying the present invention to a steam gasification process.

We believe that during the combustion stage of a conventional steam gasification process, the presence of water causes decomposition of the calcium sulfide to release hydrogen sulfide, which, in turn, is oxidized to sulfur dioxide. The reaction of calcium sulfide with water therefore, we believe competes with the oxidation of calcium sulfide to calcium sulfate which lowers the overall sulfur capture efficiency of the ash. Therefore, one aspect of the present invention is the elimination of steam in the combustion stage of a steam gasification process by injecting the steam directly into the gasification stage, in order to avoid decomposition of the calcium sulfide.

The experimental results described in the ensuing paragraphs demonstrate additional advantages of the present invention in enhancing the performance of fixed-bed gasifiers.

By way of background, in a fixed-bed gasifier, the coal moves downward through the gasifier and the gases moves upward, creating counter current contacting between gas and solids. Coal is fed, and product gases are removed, from the top of the gasifier. Ash is removed, and a steam/oxygen or steam/air mixture injected, at the bottom of the gasifier. As the coal travels down through the gasifier, it passes initially through a reducing zone and finally into a combustion zone where the oxygen injected at the bottom burns the residual carbon, leaving a hot ash which preheats the steam/oxygen (air) feed gas.

Thus, a fixed bed gasification reactor effectively permits exposure of a coal-sulfur absorbent mixture to reducing conditions prior to combustion, as required for effective sulfur capture in accordance with the present invention. We have found that such prior exposure to reducing conditions, coupled with the proper preparation of the coal-sulfur absorbent mixture, in accordance with the invention, permits effective sulfur capture to take place in fixed bed gasifiers at temperatures considerably higher than previously thought possible; for example, on the order of about 1800° F.

Furthermore, as will be shown below, we have also made the surprising discovery that the exposure of an appropriately prepared coal-sulfur absorbent mixture to reducing conditions in a fixed bed gasification reactor prior to combustion, as described in the present application, results in the production of raw products from the gasifier which are substantially free of any liquid hydrocarbon phase, e.g., tars.

In the experiments reported below, continuous gasification tests were conducted on a refractory lined, cylindrical shell fixed bed gasifier having an inner diameter of 8 inches and a depth of 12 feet.

The treated coal pellet samples were prepared for continuous fixed-bed gasification testing using technical grade lime (CaO), which was first slaked with warm water to prepare a hot (160°-200° F.) slurry of calcium hydroxide ($Ca(OH)_2$) To this slurry was added hot water and finely ground, −20 mesh (smaller than 0.33 inch diameter), 5 percent sulfur Illinois No. 6 coal. The mixture was allowed to react for approximately 15 minutes at a temperature in excess of 160° F. and then transferred to an agitated 100 gallon surge tank. The 40 percent solid slurry was pumped to one of three basket centrifuges where the excess water was removed The treated cake from the centrifuge contained approximately 20-25 precent moisture. This cake was stored in closed drums and pelletized without further treatment into approximately $\frac{3}{4}\times 1$ inch pellets. The pellets were allowed to air dry to final moisture content of approximately 8 percent before being gasified. The pellets, which contained a calcium-to-sulfur mole ratio of 4.7, were fed into the above described fixed-bed gasifier.

In Table 2, below, results from the most highly instrumented experiment are compared with published results for a typical fixed-bed type commercial (i.e., Wellman-Galusha) gasifier.

TABLE 2

COMPARISON OF PERFORMANCE IN A FIXED-BED GASIFIER

| | Pre-treated Coal | Untreated Typical Bituminous Coal |
|---|---|---|
| Coal Throughput, lbs/ft$^2$ of reactor cross section-hr | 189 | 89 |
| Steam/Coal Ratio, lbs/lb | 0.13 | 0.4 to 0.7 |
| Air/Coal ratio, lbs/lb | 1.7 | 3.5 |
| Gas Composition, Vol. % (dry): | | |
| CO | 38.8 | 20.4 |
| $H_2$ | 10.7 | 15.5 |
| $CH_4$ | 1.8 | 2.4 |
| $H_2S$ | 0.05 | 0.5 |
| $CO_2$ | 1.4 | 8.7 |
| $N_2$ | 47.2 | 52.5 |
| | 99.95 | 100.0 |
| Gas Heating Value, Btu/SCF | 178 | 120-168 |
| Tar Yield, wt % of coal | none detectable | 6 |
| Maximum Bed Temperature, °F. | 1850 | 2370 |
| Sulfur Capture by Ash, % of sulfur in feed coal | 94 | 0-5 |

Because of high heat losses in the small unit operating with our treated coal, compared to the commercial unit operating with untreated bituminous coal, the performance is biased in favor of the published test results for untreated coal. However, in spite of this bias, our results, as shown in Table 2, clearly illustrate superiority over the prior art.

In reviewing the comparative results shown in Table 2, the following benefits resulting from the practice of the present invention are apparent:

(1) A two fold increase in gasifier throughput, which substantially reduces investment costs for the gasifiers.

(2) Reduced steam requirements, which reduce steam generation costs, and reduced air requirements, which allow production of a higher heating value gas and reduced blower costs.

(3) A higher gas heating value, which reduces the derating of boilers designed for natural gas or oil.

(4) Tar formation was substantially eliminated which reduces costs for the following reasons: (a) no tar removal system is necessary; (b) water treatment costs are greatly reduced, because the condensate does not contain the high concentration of phenolic compounds found in the tars; (c) the need for special safeguards for operating personnel because of the potentially carcenogenic nature of the tars is eliminated; and (d) for many applications, the absence of the tars allows the gas to be used hot, thus further reducing costs. Thus, the present invention serves to remove what has proved a critical barrier to the commercial acceptance of fixed-bed gasifier technology.

(5) Improved sulfur capture in the ash. The ability to trap sulfur in the ash from the gasifier is a significant benefit. For example, sulfur removal systems for atmospheric pressure gasifiers are complex chemical plants compared to the simple gasifier, and result in almost doubling the price of the product gas. For pressurized gasifiers, the economics improve, but nevertheless, the present invention results in significant cost saving as well as a major simplication of the entire process.

It will be apparent to those skilled in the art that various modifications and variations can be made in the process of the present invention without departing from the scope or spirit of the invention. Thus, it is intended that the present invention cover the modification and variations of the invention, provided they come within the scope of the appended claims and their equivalents.

What is claimed is:

1. A method of combusting solid particulate carbonaceous fuel containing sulfur, comprising the steps of:

(a) treating said fuel by mixing it with an aqueous solution including a calcium-containing sulfur absorbent at at least ambient temperature to mix said sulfur absorbent with said fuel;

(b) providing a reactor and exposing said treated fuel to a reducing atmosphere in said reactor at a temperature of between about 1500° F. and about 1800° F. for converting at least about 20% of the solid carbonaceous material in said fuel to the gaseous state while forming a solid char material containing said sulfur and compounds of calcium; and (c) providing a combustor and passing said char material from said reactor to said combustor and combusting said char material in said combustor at a temperature of at least about 2100° F. in the presence of sufficient oxygen to promote the reaction of said sulfur and said compounds of calcium to form calcium sulfate, thereby forming gaseous combustion products substantially free of gaseous sulfur compounds and an ash containing sulfur fixed therein as calcium sulfate.

2. A method as claimed in claim 1, wherein the sulfur absorbent comprises calcium oxide, calcium hydroxide, calcium carbonate, lime, limestone, dolomite, or mixtures thereof.

3. A method as claimed in claim 1, wherein sufficient sulfur absorbent is utilized to provide a ratio of moles of absorbent to moles of sulfur in the particulate fuel of about three or more.

4. A method as claimed in claim 1, wherein said mixture is exposed to a reducing atmosphere in an enclosed reactor for a time of from about 25 to 60 minutes.

5. A method as claimed in claim 1, wherein the portion of particulate fuel converted to the gaseous state is in the range of from about 50% to 90%.

6. A method as claimed in claim 1, wherein the combustion temperature is maintained by providing excess air for combustion.

7. A method as claimed in claim 1, wherein the combustion temperature is maintained by supplying heat to heat exchanger tubes for steam generation.

8. A method as claimed in claim 1, wherein the reactor comprises a gasification reactor.

9. A method as claimed in claim 1, wherein said reactor and said combustor comprise an integrated, substantially enclosed system with said reactor situated above said combustor.

10. A method as claimed in claim 9, wherein said system, including said reactor and said combustor, comprises a fluidized bed system.

* * * * *

UNITED STATES PATENT AND TRADEMARK OFFICE

CERTIFICATE OF CORRECTION

PATENT NO. : 4,936,047

DATED : June 26, 1990

INVENTOR(S) : Herman F. Feldlmann, et. al.

It is certified that error appears in the above-indentified patent and that said Letters Patent is hereby corrected as shown below:

Column 3, line 22, "int0" insert --into--.

Column 7, line 48, after "fluidized" insert--bed--.

Signed and Sealed this

Seventh Day of September, 1993

Bruce Lehman

*Attest:*

BRUCE LEHMAN

*Attesting Officer*

*Commissioner of Patents and Trademarks*